US005113652A

United States Patent [19]

Baines et al.

[11] Patent Number: 5,113,652

[45] Date of Patent: May 19, 1992

[54] DIESEL ENGINE EXHAUST SYSTEM

[75] Inventors: Robert G. Baines, Stowe; Colm M. P. Keegan, Nettleham; Ralph Coupland, Sudbrooke, all of United Kingdom

[73] Assignee: WABCO Clayton Dewandre Aftermarket Limited, Leeds, United Kingdom

[21] Appl. No.: 600,410

[22] Filed: Oct. 19, 1990

[30] Foreign Application Priority Data

Oct. 19, 1989 [GB] United Kingdom ..... 8923615

[51] Int. Cl.[5] ..... F01N 3/02

[52] U.S. Cl. ..... 60/288; 60/295; 60/311; 60/324; 123/323

[58] Field of Search ..... 60/288, 295, 311, 324; 123/323

[56] References Cited

U.S. PATENT DOCUMENTS

| | | | |
|---|---|---|---|
| 3,591,959 | 7/1971 | Kubis | 60/324 |
| 3,960,122 | 6/1976 | Perrin | 123/323 |
| 4,051,821 | 10/1977 | Amann | 60/324 |
| 4,354,464 | 10/1982 | Fujita | 123/323 |

*Primary Examiner*—Douglas Hart
*Attorney, Agent, or Firm*—Horst M. Kasper

[57] ABSTRACT

A branched exhaust system having a particular filter in at least one branch thereof has valves in each branch operable by control means to route exhaust gases along any selected branch. Thus when the filter in one branch requires regeneration that branch can be closed. The control means is also operable in response to an exhaust braking demand signal to maintain all valves closed so as to at least restrict the flow of exhaust gas and so apply back pressure to the engine; to apply exhaust braking.

8 Claims, 4 Drawing Sheets

DIESEL ENGINE EXHAUST SYSTEM

This invention relates to an exhaust system, more particularly to an exhaust system for commercial diesel-engined vehicles.

It is known to assist braking on commercial vehicles by fitting an exhaust brake which acts by producing back pressure in the diesel engine exhaust system. An exhaust brake comprises a valve which may be a butterfly valve or a sliding gate valve, in the exhaust gas flow path and is operable so as to at least restrict the exhaust gas flow thereby applying back pressure to the engine. It is usual, but not essential to provide an aperture in the valve or for the valve not to fully close, so allowing leakage of exhaust gas in order to limit the back pressure available. If no such leakage flow is possible, the valve operates as an exhaust brake none-the-less but can be applied without damage to the engine only for a limited period, dependent upon the length and diameter of the exhaust line to the engine and other dimensional and operational characteristics of the system.

Particulate emission from diesel engines is controlled by legislation, this commonly being accommodated by passing the engine exhaust through a particulate filter. In order to allow continued operation of the engine once the filter has become saturated it is known to provide a replaceable filter cartridge or, more usually, to regenerate the filter by burning-off the particulates. This latter technique involves, electrically heating the filter (while the vehicle is off the road) typically producing carbon dioxide and water vapour. If the filter is to be regenerated while the vehicle is running, the engine exhaust must be re-routed to by-pass the filter. Examples of exhaust systems incorporating flow lines by-passing the filter are disclosed in JP-A-59-20514, JP-A-59-20515 and JP-A-59-20516.

The design and construction of by-pass valves to enable regeneration of the filter is both complicated and expensive, added to which the filter is not active during regeneration so that the untreated exhaust gases by-pass the filter and are discharged directly to atmosphere.

According to the present invention we propose an exhaust system comprising a branched exhaust line, each line incorporating an exhaust brake, the exhaust brakes being operable by control means responsive to a signal indicating a demand for exhaust braking and a signal indicating that regeneration of a filter in one exhaust branch line is required. When exhaust braking is required, each branch is closed by a valve operable by the control means. This is the overriding consideration. In the absence of any demand for exhaust braking however, only the valve in the branch containing the filter for regeneration is closed, enabling discharge of the exhaust gases along the other branch.

One exhaust system according to the present invention comprises a branched exhaust line connected or for connection to an engine, a valve in each branch line, the valve being movable between an open and a closed position wherein the flow of exhaust gas through the branch line is at least restricted, a particulate filter in at least one of the said branches downstream of the said valve, and means for controlling opening and closing of the valves to route exhaust gas flow through a selected branch line, said control means being responsive to an exhaust braking demand signal to close any open valve and maintain the valves closed.

The exhaust line is preferably divided into two branches each having an exhaust brake valve with a particulate filter downstream thereof.

In one embodiment the exhaust valve in one branch is maintained closed and the other open, absent either a re-routing or an exhaust brake demand signal. The control means reverses the status of the valves in response to the re-routing signal which may be generated by a simple switch or advantageously, as a timed signal in response to which the valves are controlled to route exhaust gas flow through each branch line in turn and for a predetermined period of time during which, in each case, the filter in the other branch line can be regenerated. Indeed, regeneration may be triggered also by the re-routing signal.

Where the exhaust brake valve is provided with an aperture or is otherwise adapted to limit the back pressure applied to the engine, it will be understood that there will be some leakage of exhaust gas even in the regeneration mode, along the exhaust line containing the filter to be regenerated. The result is a reduction in the efficiency of regeneration. Such reduction is not, however, significant in practice.

It will be understood by those skilled in the art that the control means may be entirely electrically or electronically operated or may be electro-mechanical. In one embodiment, the control means comprises two fluid control valves delivering fluid pressure to operate the respective exhaust branch line control valve actuators.

Where the control valves are solenoid valves, energisation is selectively controlled by a re-routing switch or timer as described above. Fluid logic control means may however, be used where fluid pressure re-routing and exhaust braking demand signals are more conveniently generated and, in this case, the two control valves are biased respectively toward a normally open and a normally closed position. By arranging the rerouting signal to act on each valve in opposition to the bias and the exhaust braking demand signal to act on the normally open valve in the same direction as the bias and on the normally closed valve in opposition to the bias, the exhaust braking mode is available even in the pressure of a re-routing signal; the exhaust braking demand signal takes precedence.

Embodiments of the present invention will now be described by way of example with reference to the accompanying drawings of which:

Figs. 1*a* to 1*c* respectively show schematically an exhaust system according to the invention, during normal running, filter regeneration and exhaust braking;

Figure 1A:
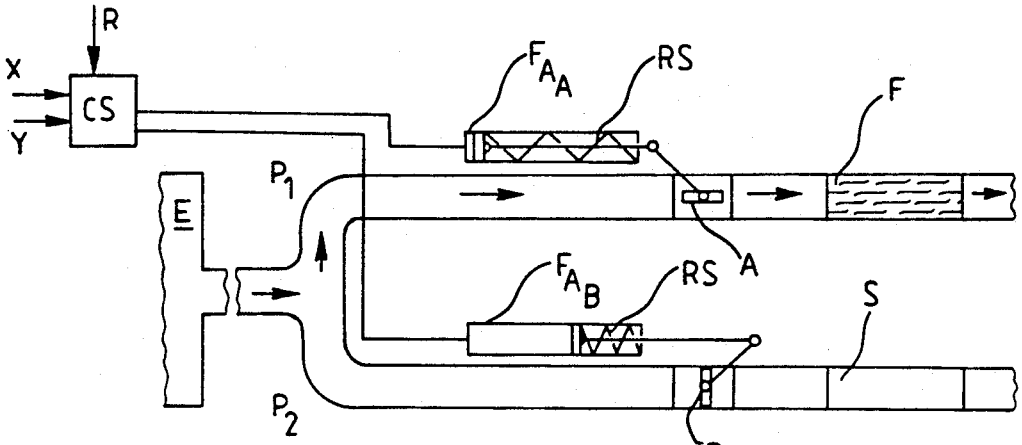
Figure 1B:
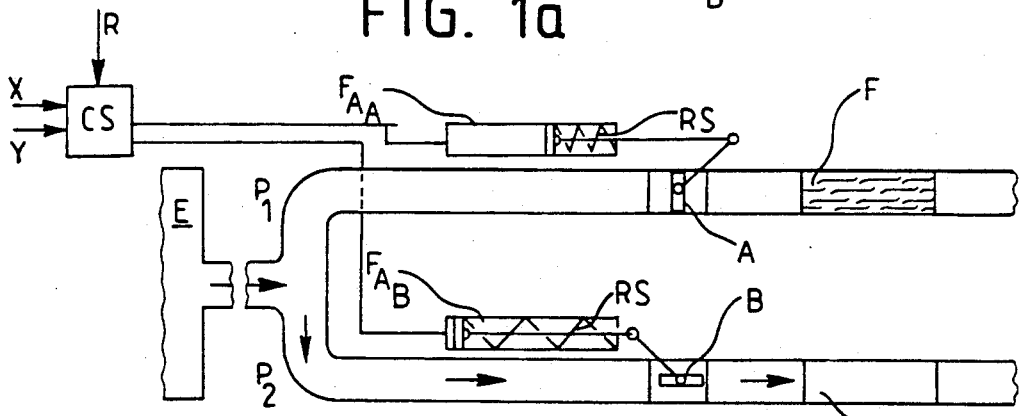
Figure 1C:
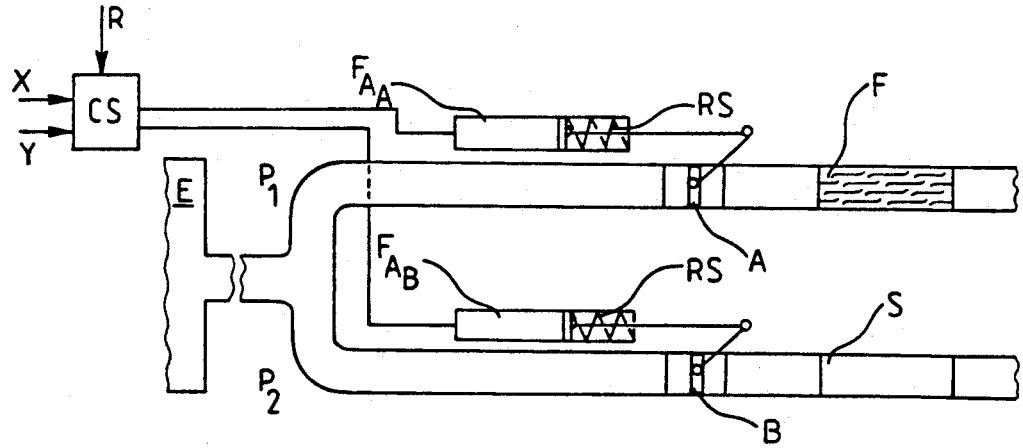

As shown in FIGS. 1*a* to 1*c*, the exhaust from the engine E is provided with two flow paths $P_1$, $P_2$ to atmosphere. One flow path $P_1$, passes through exhaust brake "A", then through the particulate filter F to atmosphere. The other flow path $P_2$ passes through exhaust brake "B" and then through a silencer S to atmosphere. (The particulate filter in this embodiment acts as a silencer). The exhaust brakes A and B are butterfly-type valves, each under the control of a fluid operated actuator FA arranged to close the valve against the bias of a return spring RS.

The exhaust brakes are opened and closed using a control system CS which provides three working states corresponding respectively to FIGS. 1*a* to 1*c*:

1. Normal operation: exhaust brake valve "A" open, and valve "B" shut. Flow passes through the filter.

2. Regeneration: exhaust brake valve "A" shut, and valve "B" open. Flow bypasses the filter 10.

3. Braking: exhaust brake valve "A" shut, and valve "B" shut. Flow is restricted so as to produce back pressure in the engine (not shown).

There are two inputs to the control system a first signal, a rerouting signal, "Y" requesting bypass of the particulate filter F, and a second signal "X" requesting exhaust braking.

The control system provides outputs to produce the three working states described previously, such that with no input signal normal operation occurs Input signal "Y" results in regeneration, input signal "X" results in exhaust braking, and input signals "X" and "Y" together also result in exhaust braking.

Figure 2:
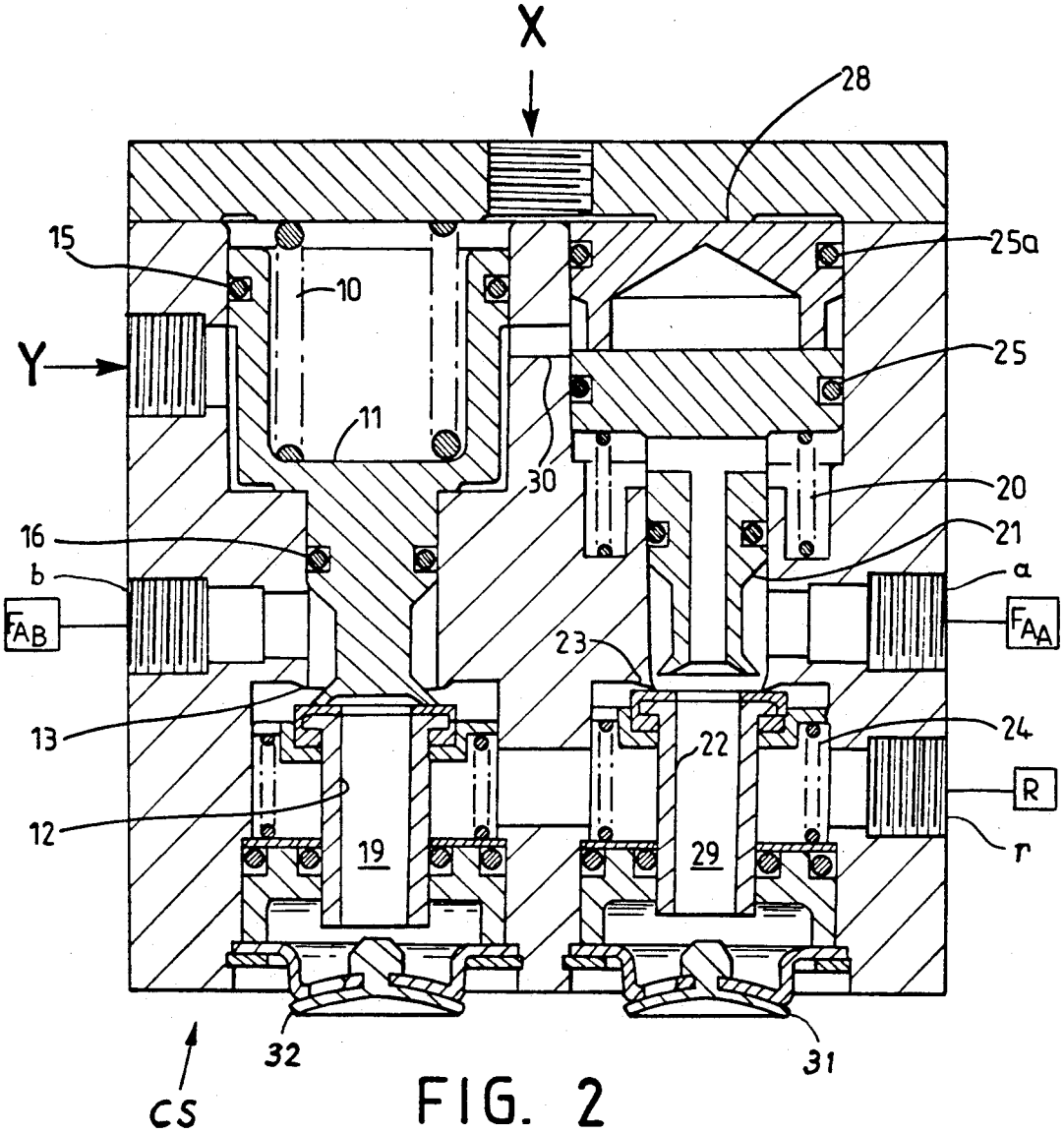
FIG. 2 is a cross-section of a fluid logic control valve for controlling the system of FIG. 1.

FIG. 2 shows a pneumatic valve CS with pressure input signals "Y" and "X" for the particulate filter and the exhaust brake respectively, and pressure outputs ports "a" and "b" connected to the exhaust brake actuators $FA_A$ and $FA_B$ such that pressure shuts the exhaust brake and absence of pressure allows it to open.

Air from a reservoir R is delivered to port r.

A similar valve could be operated by oil pressure.

It will be understood by those skilled in the art that other control mediums, such as electronic, fluidic or optical means could be needed to achieve the same logical result.

In normal running there are no control inputs to the control valve. Ports "X" and "Y" are at atmospheric pressure, spring 10 holds exhaust seat 11 against valve element 12 so that valve element 12 is held off inlet seat 13 and reservoir air pressure is delivered from port r vis port "b" to exhaust brake valve "B". The air pressure acts on the piston of actuator $FA_B$ to hold the valve "B" in a closed position, so that little or no exhaust gas passes through it. Spring 20 holds exhaust seat 21 away from valve element 22, which is itself held against inlet seat 23 by spring 24, thus isolating port "a" from the reservoir pressure and connecting it to atmosphere via the exhaust passage 29 and exhaust valve 31. Exhaust brake valve "A" is held in an open position by means of its actuator return spring RS and the engine exhaust gases follow path $P_1$, passing through exhaust brake valve "A" and so through the particulate filter F before going to atmosphere (FIG. 1*a*).

In accordance with a timing or other parameter, the signal "Y" is produced to indicate that regeneration is needed—the regeneration mode. In the embodiment of FIG. 2 this signal is seen as air pressure (typically 8 bar) which acts over the annulus between seals 15 and 16 to overcome the spring 10 and lift the exhaust seat 11 away from the valve 12 so that the valve 12 is held against the inlet seat 13 by spring 14 and isolates port "b" from reservoir pressure while connecting it to atmospheric pressure via the exhaust passage 19 and exhaust valve 32. Exhaust brake valve "B" then opens under the action of its actuator return spring RS, thus allowing engine exhaust gases to follow flow path $P_2$ through exhaust valve brake "B" to the silencer and to atmosphere.

The air pressure at "Y" also passes through passage 30 and acts over the area contained by seal 25 to overcome spring 20 and push exhaust seat 21 against valve 22, overcoming spring 24 to push valve 22 away from inlet seat 23, thus isolating port "a" from atmosphere and connecting it to reservoir pressure. The reservoir pressure then acts to overcome the actuator return spring of actuator $FA_A$ and closes exhaust brake valve "A" thus preventing the engine exhaust gases from following path $P_1$, and thereby allowing the particulate filter to be put into regenerate mode (FIG. 1*b*).

A demand for exhaust braking is seen as an air pressure signal "X" (typically 8 bar). This pressure acts on the area enclosed by seal 15 to reinforce the action of spring 10 so that as previously described exhaust brake valve "B" is held in a closed position, preventing engine exhaust flow through path $P_2$. The pressure at "X" also acts on the area enclosed by seal 25*a*, to overcome spring load 20 to move exhaust seat 21 against valve element 22 so as to close the exhaust passage 29 and isolate port "a" from atmosphere. The exhaust seat and the valve are then moved further, overcoming spring 24, to allow the pressure from the air reservoir to pass between the valve 22 and the inlet seat 23 to port "a" and thence to actuator $FA_A$, where the pressure overcomes the actuator return spring RS and closes the exhaust brake valve A, thus preventing engine exhaust flow through path $P_1$. The engine exhaust flow is now blocked at both exhaust brakes, and the system is thus in exhaust braking mode FIG. 1*c*).

In the event of exhaust braking being requested when in regeneration mode, equal air pressure signals "X" and "Y" (typically 8 bar) are applied. Exhaust seat 11 moves to the down position under the influence of spring 10, reinforced by air pressure over the area enclosed by seal 16, the annulus between seals 15 and 16 being balanced. Exhaust brake valve "B" thus or is held closed, as previously described. The pressure also acts on the area enclosed by seal 25*a* to push down piston 28 against exhaust seat 21, overcoming springs 20 and 24 as previously described, so that reservoir pressure goes to, and closes, exhaust brake valve "A". The same end condition is obtained if regeneration is requested when in exhaust braking mode.

Both exhaust brakes are then in the closed position and the system is in exhaust braking mode. However, as no (or only leakage) flow is passing through the particulate filter this can remain in regenerate mode. The two functions therefore do not interfere with one another.

Figure 3:
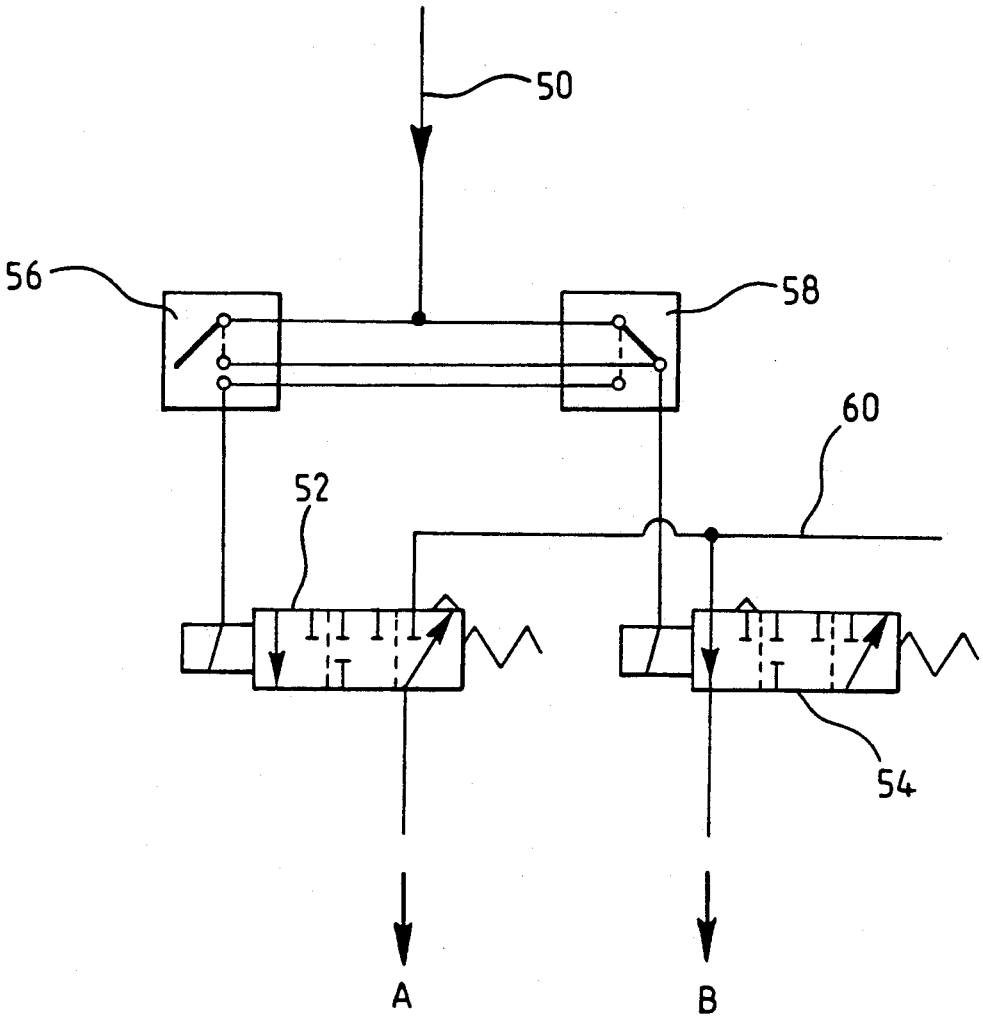
FIG. 3 is a diagram of an electrical logic control means suitable for operating the system of FIG. 1.

In electrically controlled embodiment of FIG. 3 an electrical supply line 50 is connected to energise two solenoid valves 52 and 54 via an exhaust brake switch 56 and a particulate filter switch 58 which operates according to a timing or other parameter when it is required to bypass the filter. There is also an exhaust brake switch which is operated by the driver when exhaust braking is needed. This switch 58 may be disposed for operation by movement of the foot-brake pedal or comprise a switch mounted on the control panel.

In the normal running mode, current is supplied via the particulate filter switch 58 to the solenoid 54 controlling exhaust brake valve "B" so as to supply reservoir air pressure 60 to keep valve "B" closed. There is no current to the solenoid 52 controlling exhaust brake valve "A", so that valve "A" is at atmospheric pressure and remains open, under the action of its actuator return spring as previously described.

Path $P_1$ is open and path $P_2$ is closed so that the exhaust gases go to atmosphere via the particulate filter.

When the particulate filter switch 58 is operated the current is switched from the solenoid 54 controlling exhaust brake valve "B" to that controlling exhaust brake valve "A". The actuator for exhaust brake valve "B" is now connected to atmosphere and the return spring opens it, whereas the actuator for exhaust brake valve "A" is connected to reservoir pressure 60 and closes exhaust brake valve "A".

Path $P_1$ is now closed and path $P_2$ is open, so that the exhaust gases bypass the particulate filter and go to atmosphere via the silencer.

When the exhaust brake switch 56 is operated, current is supplied to both solenoid valves 52, 54, regardless of the position of the particulate filter switch 58, so that both actuators are connected to reservoir air pressure and both exhaust brakes are held in the closed position. The engine exhaust gases are now substantially prevented from going to atmosphere, and a back pressure is generated in the engine, which provides a braking effect on the vehicle.

Figure 4:
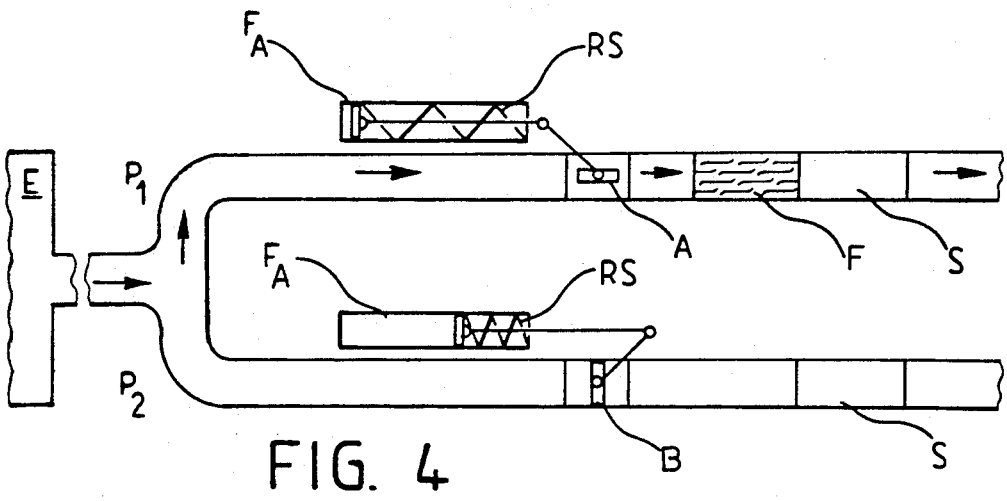
FIG. 4 shows schematically a system similar to the system of FIG. 1 but incorporating a silencer in each exhaust line branch.

In FIG. 4 a silencer S is shown in path $P_1$ downstream of the particulate filter F.

Figure 5:
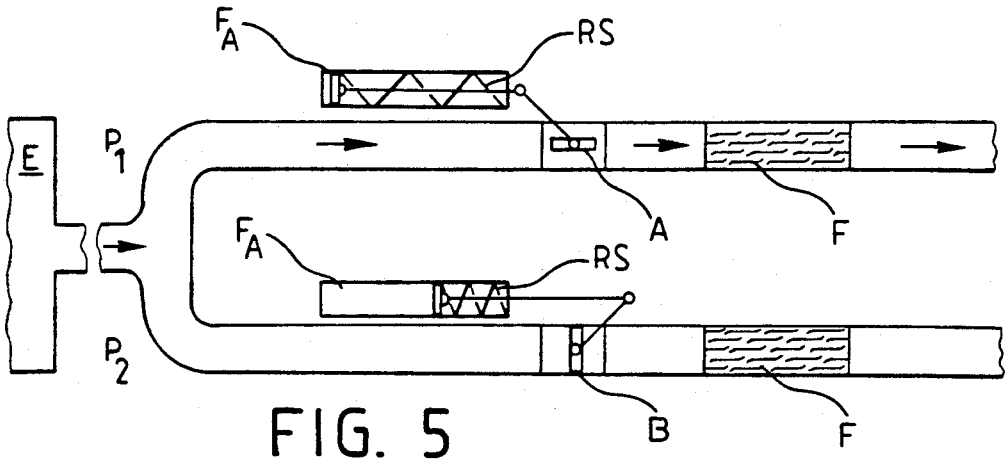
FIG. 5 shows schematically a system similar to the system of FIG. 1 but incorporating a particulate filter in each exhaust line branch.
Figure 6:
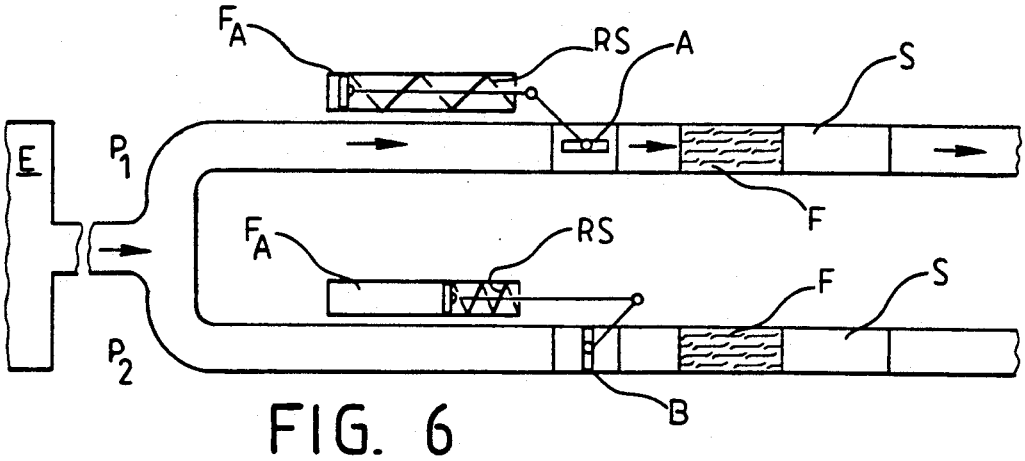
FIG. 6 shows the system of FIG. 5 but with a silencer fitted in each exhaust line branch.

In FIG. 5 the silencer S in path $P_2$ is replaced by another particulate filter F so that the exhaust gases always pass through a filter, with one filter F being regenerated while the other is being used. FIG. 6 is as FIG. *5a*, but with the addition of a silencer S downstream of each particulate filter F.

We claim:

1. An exhaust system comprising a plurality of branched lines for connection to an engine, a valve in each of said branch lines, each of the valves being movable between an open and a closed position wherein the flow of exhaust gas through the respective branch line is at least restricted, a particulate filter in at least one of said branches downstream of said valve, and means for controlling opening and closing of the valves to route exhaust gas flow through a selected one of said branch lines, said control means being responsive to an exhaust braking demand signal to close any open valve and maintain the valves closed.

2. A system according to claim 1, wherein the exhaust line is divided into two branches, each of said branches having a valve and a particulate filter downstream thereof.

3. A system according to claim 1 wherein the control means is arranged to maintain the valve in one branch closed and the valve in another branch open and wherein in response to a rerouting demand signal, the control means maintains the valve in the said one branch open and the other valve closed.

4. A system according to claim 1 wherein each valve is biased toward the open position and is movable by an actuator into the closed position.

5. A system according to claim 1 comprising means for generating a timed re-routing signal, the control means responding thereto by controlling operation of the valves to route exhaust gas flow through each branch line in turn and for a predetermined period of time.

6. A system according to claim 1 wherein the control means comprises two control valves each for controlling communication between a branch-line valve fluid actuator and a supply of fluid under pressure, one of said control valves being normally open and the other being normally closed, the control valves being operable in response to a re-routing signal such that the said one control valve closes and the other opens.

7. A system according to claim 6 wherein the two control valves are solenoid operated valves connected to a re-routing switch means for selectively controlling energisation of the solenoid operated control valves such that one control valve is normally open and the other closed, the said exhaust braking demand signal being provided by an exhaust brake switch operable to energise both solenoid operated control valves.

8. A system according to claim 6, the control means comprising a fluid logic control means incorporating the said two control valves which are biased respectively toward the said normally open and the said normally closed position and responsive to fluid pressure re-routing and exhaust braking demand signals, wherein the control means is connected and arranged such that the re-routing signal is applied to act in opposition to the bias of each control valve and such that the exhaust braking demand signal acts to supplement the bias of the normally open control valve and in opposition to the bias of the normally closed control valve.

* * * * *

UNITED STATES PATENT AND TRADEMARK OFFICE

CERTIFICATE OF CORRECTION

PATENT NO. :5,113,652
DATED :May 19, 1992
INVENTOR(S) :Robert George Baines, et. al.

It is certified that error appears in the above-indentified patent and that said Letters Patent is hereby corrected as shown below:

On the Title page, item [73], Assignee: delete "WABCO Clayton Dewandre Aftermarket Limited, Leeds, United Kingdom" and substitute therefor--Wabco Automotive UK Limited--.

Signed and Sealed this

Seventh Day of June, 1994

*Attest:*

Bruce Lehman

BRUCE LEHMAN

*Attesting Officer*

*Commissioner of Patents and Trademarks*